US011300120B2

(12) United States Patent
Peters et al.

(10) Patent No.: US 11,300,120 B2
(45) Date of Patent: Apr. 12, 2022

(54) DISPLACEMENT PUMP FOR MEDICAL LIQUIDS, BLOOD TREATMENT DEVICE, AND METHOD FOR CONTROLLING SAME

(71) Applicant: FRESENIUS MEDICAL CARE DEUTSCHLAND GMBH, Bad Homburg (DE)

(72) Inventors: Arne Peters, Bad Homburg (DE); Christoph Wiktor, Gelnhausen (DE); Gokhan Orter, Weilmunster (DE)

(73) Assignee: Fresenius Medical Care Duetschland GmbH, Bad Homburg (DE)

( * ) Notice: Subject to any disclaimer, the term of this patent is extended or adjusted under 35 U.S.C. 154(b) by 208 days.

(21) Appl. No.: 16/469,671

(22) PCT Filed: Dec. 17, 2017

(86) PCT No.: PCT/EP2017/083184
§ 371 (c)(1),
(2) Date: Jun. 14, 2019

(87) PCT Pub. No.: WO2018/114727
PCT Pub. Date: Jun. 28, 2018

(65) Prior Publication Data

US 2019/0383282 A1 Dec. 19, 2019

(30) Foreign Application Priority Data

Dec. 20, 2016 (DE) ..... 10 2016 015 110.2

(51) Int. Cl.
*F04B 49/20* (2006.01)
*F04B 43/04* (2006.01)
(Continued)

(52) U.S. Cl.
CPC ..... *F04B 49/20* (2013.01); *F04B 43/0081* (2013.01); *F04B 43/04* (2013.01);
(Continued)

(58) Field of Classification Search
CPC .... F04B 43/067; F04B 43/0081; F04B 49/22; F04B 49/20; F04B 49/08; F04B 2205/05; F04B 43/04; F04B 2205/03
See application file for complete search history.

(56) References Cited

U.S. PATENT DOCUMENTS 3,951,568 A * 4/1976 Carlson, Jr. ..... F04B 49/08 417/27
4,634,430 A 1/1987 Polaschegg
(Continued)

FOREIGN PATENT DOCUMENTS

DE 4309380 A1 9/1994
DE 102012113087 A1 7/2014
(Continued)

OTHER PUBLICATIONS

International Search Report and Written Opinion issued in corresponding International Patent Application No. PCT/EP2017/083184 (with English translation of International Search Report) dated Mar. 6, 2018 (12 pages).
(Continued)

*Primary Examiner* — Christopher S Bobish
(74) *Attorney, Agent, or Firm* — Kilyk & Bowersox, P.L.L.C.

(57) ABSTRACT

The invention relates to a positive displacement pump 1 for conveying medical fluids, which pump has a pumping chamber 5 and a positive displacement element 15, and to a blood treatment apparatus comprising a positive displacement pump 1. In addition, the invention relates to a method for controlling a positive displacement pump 1 for conveying medical fluids. The positive displacement pump 1 according to the invention has an actuation member 20 in operative connection with the positive displacement element 20 for displacing or deforming the positive displacement element in order to convey the fluid into the pumping
(Continued)

Figure 1:
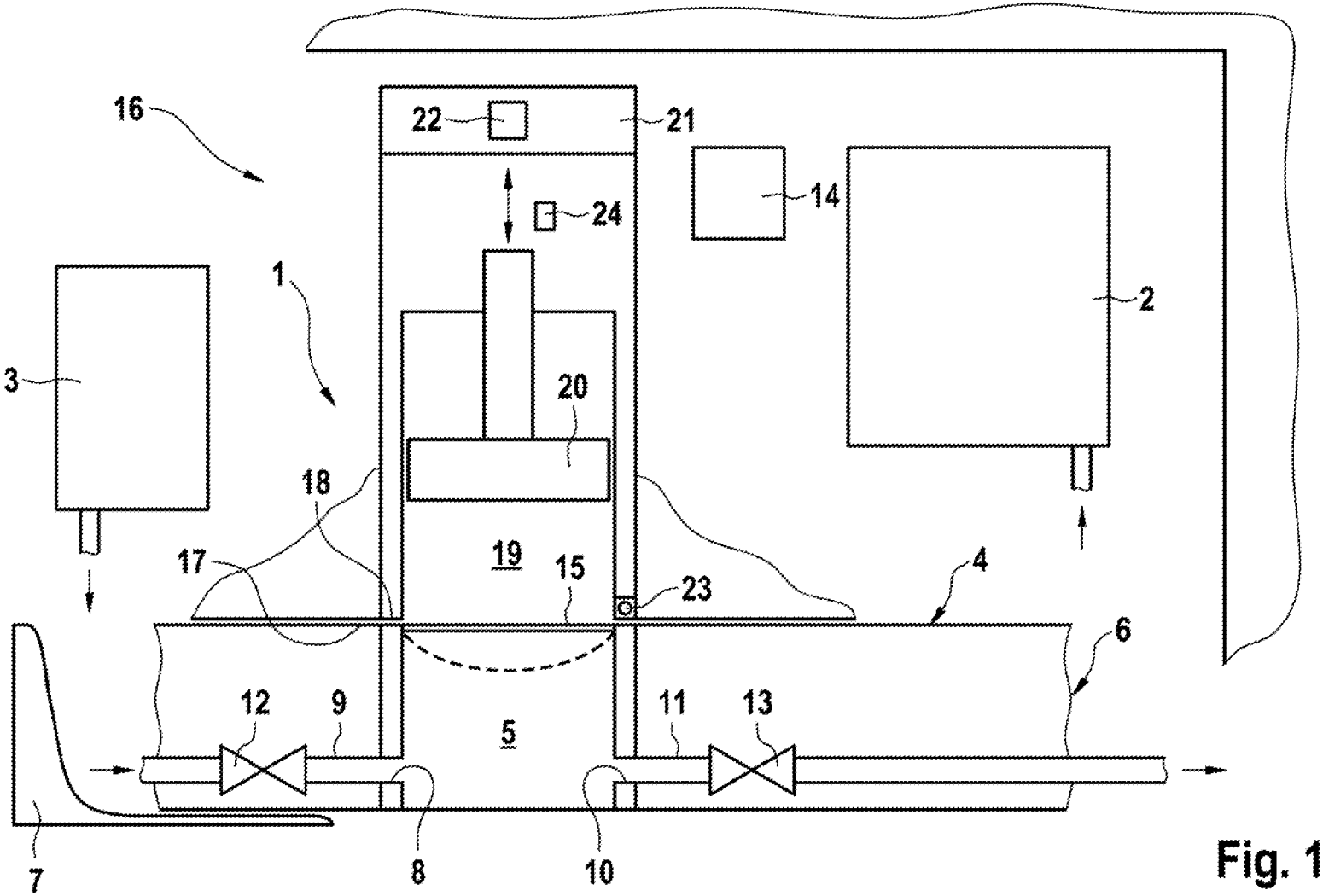

chamber or out of the pumping chamber, and a drive device 21 for displacing the actuation member 20. A control unit 14 is provided for to controlling the drive device 21 and an inlet valve 12 and outlet valve 13. The actuation member 20 is in operative connection with the positive displacement element 15 via a working chamber 19 that is filled with gas and has a sealed volume. In order to achieve a high conveying precision, the pressure in the working chamber 5 is kept constant when the positive displacement element 15 is moved.

14 Claims, 2 Drawing Sheets

(51) Int. Cl.
*F04B 43/067* (2006.01)
*F04B 49/22* (2006.01)
*F04B 43/00* (2006.01)
*F04B 49/08* (2006.01)

(52) U.S. Cl.
CPC ..... *F04B 43/067* (2013.01); *F04B 49/08* (2013.01); *F04B 49/22* (2013.01); *F04B 2205/03* (2013.01); *F04B 2205/05* (2013.01)

(56) References Cited

U.S. PATENT DOCUMENTS 4,950,134 A * 8/1990 Bailey ..... F04B 43/067 417/383
5,332,372 A * 7/1994 Reynolds ..... F04B 43/009 417/393
6,302,653 B1 * 10/2001 Bryant ..... F04B 51/00 417/383
6,973,373 B2 * 12/2005 Gray ..... F04B 43/0081 700/282
8,317,774 B2 * 11/2012 Adahan ..... F04B 43/067 604/543
8,845,298 B2 * 9/2014 Larsen ..... F04B 43/107 417/2
9,850,889 B2 * 12/2017 Van De Velde ..... F04B 43/086
10,076,604 B2 9/2018 Heitmeier et al.
10,227,974 B2 * 3/2019 Dehnen ..... G01L 19/0007
2005/0207912 A1 * 9/2005 Lolli ..... F04B 43/0054 417/395
2011/0135514 A1 * 6/2011 Huhnke ..... F04B 53/08 417/395
2015/0064025 A1 3/2015 Verdugo et al.

FOREIGN PATENT DOCUMENTS

DE 102014016526 A1 5/2016
EP 0156211 A2 10/1985
GB 2053378 A 2/1981

OTHER PUBLICATIONS

International Preliminary Report on Patentability issued in corresponding International Patent Application No. PCT/EP2017/083184 dated Jun. 25, 2019 (8 pages).

* cited by examiner

DISPLACEMENT PUMP FOR MEDICAL LIQUIDS, BLOOD TREATMENT DEVICE, AND METHOD FOR CONTROLLING SAME

This application is a National Stage Application of PCT/EP2017/083184, filed Dec. 17, 2017, which claims priority to German Patent Application No. 10 2016 015 110.2, filed Dec. 20, 2016.

The invention relates to a positive displacement pump for conveying medical fluids, which pump has a pumping chamber and a positive displacement element, and to a blood treatment apparatus comprising a positive displacement pump. In addition, the invention relates to a method for controlling a positive displacement pump for conveying medical fluids.

The known positive displacement pumps have a pumping chamber and a positive displacement element. The fluid is conveyed as a result of the change in volume brought about by the movement of the positive displacement element in the pumping chamber. In the case of the known reciprocating pumps, the positive displacement element is a piston that is guided in a hollow cylinder and actuated by a drive unit.

In medical technology, membrane pumps are used to convey medical fluids. The advantage of membrane pumps lies in the separation, by a membrane, of the drive unit from the fluid to be conveyed. In medical technology, high demands are made of membrane pumps. The membrane pumps are intended to have a very high conveying precision. Membrane pumps having a high conveying precision are used in dialysis, for example.

In dialysis units, membrane pumps are used which have an assembly on the unit and an assembly that is intended for single use only and can be in the form of a cassette (disposable). The cassette comprises a pumping chamber which is closed by a resilient membrane. The assembly on the unit comprises an actuation member, by means of which the membrane is deformed in such a way that there is a change in volume in the pumping chamber, as a result of which the medical fluid is conveyed. In the suction phase, the outlet of the pumping chamber is closed by an outlet valve, while the inlet of the pumping chamber is closed in the pressure phase by an inlet valve.

The assembly of the membrane pump on the disposable can be coupled to the assembly on the unit such that the actuation member can deform the membrane. Owing to the two-piece design of the membrane pump, a permanent connection between the actuation member and the membrane is not possible.

Reciprocating-membrane pumps are known from the prior art for producing high pressures in machines, in which pumps the membrane is in operative connection via a working space which is filled with hydraulic oil as the working fluid. As a result, the load on the membrane should be relieved and the useful life thereof increased.

The object of the invention is to provide a positive displacement pump for use in medical technology for conveying medical fluids, which pump allows separation of an assembly on the unit and an assembly on the disposable. In particular, the object of the invention is to provide a positive displacement pump in a two-piece construction for conveying medical fluids with a high conveying precision. In addition, an object of the invention is to provide a blood treatment apparatus comprising a positive displacement pump, and to specify a method for controlling a membrane pump, it being possible to separate the positive displacement pump into an assembly on the unit and an assembly on the disposable.

These objects are achieved according to the invention by the features of the independent claims. The dependent claims relate to advantageous embodiments of the invention.

The positive displacement pump for medical fluids according to the invention has a pumping chamber, a positive displacement element, an actuation member in operative connection with the positive displacement element for displacing or deforming the positive displacement element in order to convey the fluid into the pumping chamber or out of the pumping chamber, and a drive device for displacing the actuation member. A control unit is provided for controlling the drive device and the inlet valve and outlet valve. The control unit is designed such that, in the suction phase, the inlet valve is open and the outlet valve is closed and, in the pressure phase, the inlet valve is closed and the outlet valve is open.

In principle, the positive displacement element can have various designs. In a preferred embodiment, the positive displacement pump is a membrane pump which comprises a deformable membrane as the positive displacement element, which membrane seals off the pumping chamber. However, the positive displacement element can also be a piston in a hollow cylinder.

In the positive displacement pump according to the invention, the actuation member is not rigidly connected to the positive displacement element, but rather the actuation member is in operative connection with the positive displacement element via a working chamber that is filled with gas and has a sealed volume. Since there is no rigid connection between the actuation member and the positive displacement element, the positive displacement pump according to the invention allows a two-piece construction that has an assembly on the unit and a single-use assembly on the disposable.

When the actuation member is moved, the volume of gas enclosed in the working chamber is displaced, such that the positive displacement element is actuated by the volume of gas. The volume of gas displaced by the actuation member corresponds to the volume of fluid that is displaced from the pumping chamber by the positive displacement element.

The positive displacement pump according to the invention provides an actuation device on the unit and a pumping device on the disposable, the drive device, the actuation member and the working chamber being components of the actuation device on the unit, and the positive displacement element and the pumping chamber being components of the pumping device on the disposable. It is also possible that an actuation device on the unit and a pumping device on the disposable are not provided.

In the embodiment comprising the actuation device on the unit and the pumping device on the disposable, the actuation device on the unit and the pumping device on the disposable are preferably designed such that the pumping device on the disposable can be coupled to the actuation device on the unit. When the pumping device is coupled to the actuation device, an operative connection is produced between the actuation member and the positive displacement element via the volume of gas enclosed in the working chamber, such that the actuation member can actuate, for example displace or deform, the positive displacement element.

The working chamber can have various designs. The working chamber is preferably a cylindrical body (hollow cylinder), in which a piston is guided as the actuation member. When the piston is moved in the hollow cylinder, the volume of gas enclosed in the hollow cylinder is displaced, such that the positive displacement element is actuated by the volume of gas.

The drive device preferably comprises an electric motor for driving the actuation member, which electric motor is controlled by the control unit.

In order to precisely set the pump output or conveyance rate, the positive displacement pump according to the invention provides a particular design of the control unit when coupling the actuation member and positive displacement element via a volume of gas, in particular a volume of air, enclosed in the working chamber.

In a preferred embodiment, the control unit comprises a pressure measuring device, for example an electronic pressure sensor, for measuring the pressure in the working chamber. The control unit is designed such that, in the pressure phase, the outlet valve is controlled depending on the pressure measured by the pressure measuring device such that the pressure p in the working chamber remains constant when the actuation member is displaced. This presupposes that the temperature T does not change either, which can be assumed in practice.

In addition, the control unit is preferably designed such that the drive device is controlled such that the pump output corresponds to a preset target pump output or the conveyance rate corresponds to a preset target conveyance rate. In the pressure phase, i.e. when the positive displacement element displaces the fluid from the pumping chamber, the actual pressure in the working chamber is constant, and therefore the conveyed volume of liquid results from the displacement path of the actuation member. In order to deliver a particular target pump output, the control unit specifies a particular distance by which the actuation member is displaced, while, in order to set a particular target conveyance rate, the control unit specifies a particular speed for the movement of the positive displacement element. This embodiment has the advantage that the target flow can be set via the displacement path of the actuation member, it being the outlet valve, rather than the actuation member, that is correspondingly controlled by the control unit in order to set the constant pressure in the working chamber.

A particularly preferred embodiment provides a path sensor for measuring the displacement path of the actuation member, the control unit being designed such that, on the basis of the measured displacement path of the actuation member, the actual pump output or the actual conveyance rate is calculated and the drive device is controlled such that the actual pump output corresponds to the target pump output or the actual conveyance rate corresponds to the target conveyance rate.

In an alternative embodiment, the control unit is designed such that, in the pressure phase, it is not the outlet valve but rather the drive device that is controlled depending on the pressure measured by the pressure measuring device such that the pressure in the working chamber remains constant when the actuation member is displaced. In addition, the control unit is preferably designed such that the outlet valve is controlled such that the actual pump output corresponds to the target pump output or the actual conveyance rate corresponds to the target conveyance rate. In the alternative embodiment, the pressure is kept constant by controlling the movement of the actuation member. The movement of the actuation member determines the actual flow. The target flow is set in this embodiment in that the outlet valve is correspondingly controlled by the control unit.

The positive displacement pump according to the invention is used in particular as a membrane pump in medicotechnical devices for conveying a medical treatment fluid, for example in a blood treatment apparatus (dialysis apparatus) for precise metering of an anticoagulant solution.

The method according to the invention for controlling a positive displacement pump for medical fluids, which pump comprises a pumping chamber, a positive displacement element, an actuation member in operative connection with the positive displacement element for displacing or deforming the positive displacement element, a drive device for displacing the actuation member and an inlet valve and an outlet valve, is characterised in that the positive displacement element is actuated by the actuation member via a sealed volume of air which is enclosed in a working space.

In a first particularly preferred embodiment, the outlet valve is controlled depending on the pressure in the working space such that the pressure in the working space remains constant when the actuation member is displaced, and the actuation member is displaced such that the pump output corresponds to a preset target pump output or the conveyance rate corresponds to a preset target conveyance rate.

In a second alternative embodiment, the actuation member is controlled depending on the pressure in the working space such that the pressure in the working space remains constant when the actuation member is displaced, and the outlet valve is controlled such that the pump output corresponds to a preset target pump output or the conveyance rate corresponds to a preset target conveyance rate.

Figure 2:
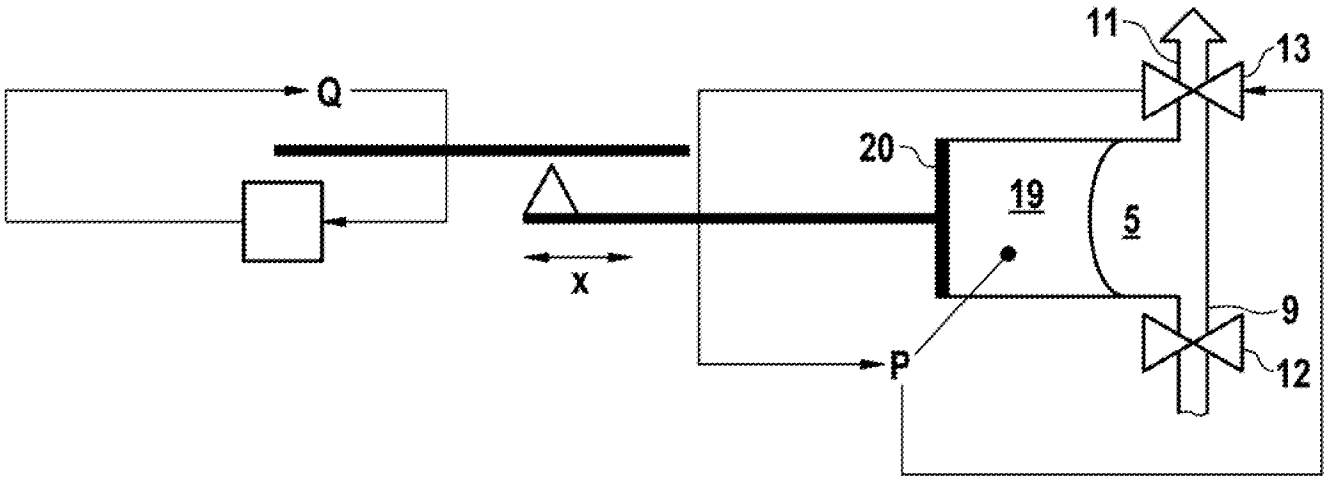
Figure 3:
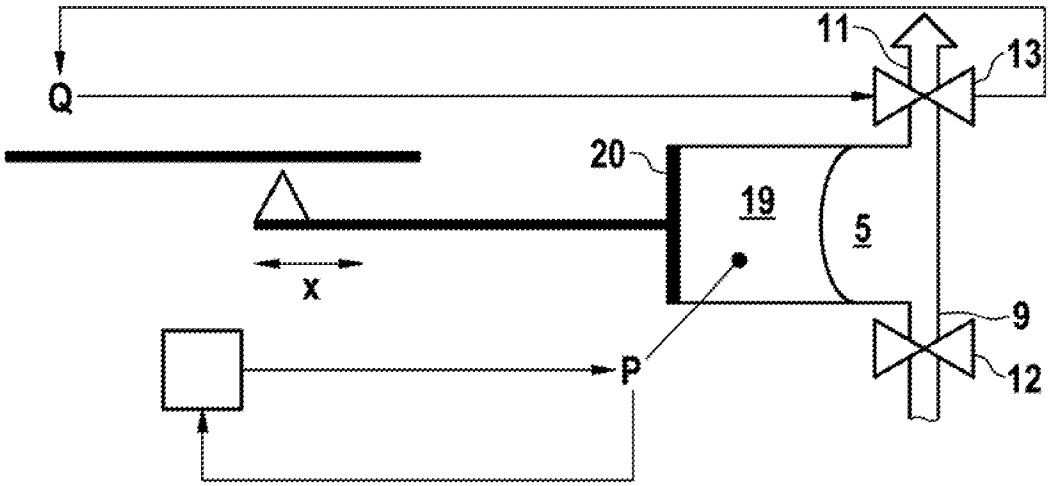

Embodiments of the invention are explained in detail below with reference to the drawings,
in which:

FIG. 1 is a simplified schematic view of an embodiment of the positive displacement pump according to the invention, FIG. 2 is a schematic diagram illustrating a first embodiment for controlling the outlet valve and the actuation member of the positive displacement pump, and FIG. 3 is a schematic diagram illustrating a second embodiment for controlling the outlet valve and the actuation member of the positive displacement pump.

FIG. 1 is a highly simplified schematic view showing a medical treatment apparatus, in particular a dialysis apparatus, which has the positive displacement pump 1 according to the invention. The dialysis apparatus comprises an extracorporeal blood circuit 2, which is shown only schematically. A medical fluid is conveyed by means of the positive displacement pump 1 in order to carry out the treatment, which fluid is provided in a container 3. In the present embodiment, an anticoagulant solution is supplied to the extracorporeal blood circuit 2 by means of the positive displacement pump 1.

The positive displacement pump 1 comprises a pumping device 4 that has a pumping chamber 5 which is a component of a cassette 6 (disposable) that is intended for single use and is inserted in a receiving unit 7 of the dialysis apparatus. The pumping chamber 5 comprises an inlet 8, to which an inlet line 9 is connected, and an outlet 10, to which an outlet line 11 is connected. The inlet line 9 is connected to the container 3 for the treatment fluid, in particular anticoagulant solution, and the outlet line 11 is connected to the extracorporeal blood circuit 2. The inflow of fluid, in particular anticoagulant solution, into the pumping chamber 5 is controlled by an inlet valve 12, and the outflow of fluid from the pumping chamber 5 is controlled by an outlet valve 13. The inlet valve 12 and the outlet valve 13, which can be in the form of electromagnetic or pneumatic valves, are controlled by a control unit 14, which may be a component of the central control unit of the treatment apparatus.

The pumping chamber 5, which can have a cylindrical pumping space, is tightly sealed by a flexible membrane 15 which is attached to the top of the cassette 6.

In addition, the positive displacement pump 1 comprises an actuation device 16 on the unit, to which actuation device the pumping device 4 on the disposable can be coupled in a sealing manner. The sealing is achieved by opposing contact surfaces 17, 18 of the pumping device 4 and of the actuation device 16.

The actuation device 16 comprises a working chamber 19 which may have a cylindrical working space that can be coupled to the pumping chamber 5 of the actuation device 4 in a sealing manner. An actuation member 20, which may be a piston, is guided in a longitudinally displaceable manner in the working chamber 19. The actuation member 20 is driven by means of a drive device 21, which may have an electric motor 22 that actuates the piston via a coupling mechanism (not shown).

When the pumping device 16 is coupled to the actuation device 4, a volume of air is enclosed in the working chamber 19 of the actuation device between the actuation member 20, i.e. the end face of the piston, such that a stroke movement of the piston leads to deformation of the positive displacement element (membrane) 15, as a result of which fluid is displaced from the pumping chamber 5. In this case, the volume of air displaced by the piston corresponds to the volume of liquid displaced from the pumping chamber.

The control unit 14 for controlling the drive device 21 and the inlet and outlet valves 12, 13 may have, for example, a general processor, a digital signal processor (DSP) for continuously processing digital signals, a microprocessor, an application-specific integrated circuit (ASIC), an integrated circuit consisting of logic elements (FPGA) or other integrated circuits (IC) or hardware components, in order to perform the individual method steps for controlling the pressure or flow. A data processing program (software) can run on the hardware components in order to carry out the method steps.

The control unit 14 controls the inlet and outlet valves 12, 13 such that, in the suction phase, the inlet valve 12 is open and the outlet valve 13 is closed, and, in the pressure phase, the inlet valve 12 is closed and the outlet valve 13 is open.

In FIG. 1, all the components are shown only schematically. The inlet and outlet valves may also have components on the disposable and on the unit.

In order to set a precise pump output or conveyance rate, the control unit 14 provides the following control for the drive device 21 of the actuation member 20 and for the inlet valve 12 and the outlet valve 13.

The invention is based on the thermal state equation of ideal gases ($p\,V=n\,R_m\,T$, in which p is the pressure, V is the volume, n is the amount of substance, $R_m$ is the molar gas constant and T is the temperature). According to the general gas equation, if the pressure p and the temperature T in the working chamber 19 are kept constant, the volume of air enclosed in the working space does not change during the stroke movement of the actuation member (piston). The pressure is therefore kept constant. The control unit 14 comprises a pressure measuring device 23, for example an electronic pressure sensor, which measures the actual pressure in the working chamber 19.

Two alternative embodiments of the control are described in the following. FIGS. 2 and 3 illustrate the control of the pressure and the flow. The individual components are provided with the same reference signs in FIGS. 2 and 3 as in FIG. 1, the pumping chamber 19 and the working chamber 5 being shown in a highly simplified manner.

In the first embodiment, the control unit 14 is configured such that, in the pressure phase, the control unit controls the outlet valve 13 depending on the pressure measured by the pressure sensor 23 such that the pressure p in the working chamber 19 remains constant during the stroke movement of the piston 20. In this case, the control unit 14 measures the actual pressure $p_{ist}$ by means of the pressure sensor 23 and compares the actual pressure with the target pressure $p_{soll}$, which is intended to be kept constant. In order to increase or reduce the actual pressure, the valve body of the outlet valve 13 is correspondingly opened or closed such that the pressure is constant.

In the first embodiment, the pump output of the positive displacement pump is controlled via the displacement path of the actuation member, which path is measured by means of a path sensor 24. The control unit 14 is configured such that the actual pump output or the actual conveyance rate is calculated on the basis of the measured displacement path of the actuation member. The displaced volume of air, which corresponds to the pump output, is calculated from the product of the displacement path x, measured by means of the path sensor 24, and the cross-sectional area of the working chamber 19 or of the end face of the piston 20. The control unit 14 controls the drive device 21 such that the actual pump output corresponds to the target pump output or the actual conveyance rate $Q_{ist}$ corresponds to the target conveyance rate $Q_{soll}$.

In the alternative embodiment, the control unit 14 is configured such that, in the pressure phase, the drive device 21 is controlled depending on the pressure measured by the pressure sensor 23 such that the pressure p in the working chamber remains constant when the actuation member is displaced. In order to increase or reduce the actual pressure past to the constant target pressure $p_{soll}$, the control unit 14 respectively increases or reduces the feed rate of the actuation member. For this purpose, the speed of the electric motor 22 can be increased or reduced. In this case, the outlet valve 13 is controlled by the control unit 14 such that the actual pump output corresponds to the target pump output or the actual conveyance rate $Q_{ist}$ corresponds to the target conveyance rate $Q_{soll}$. In order to increase or reduce the pump output or conveyance rate, the outlet valve is further opened or closed, respectively.

The invention claimed is:

1. A positive displacement pump for pumping medical fluids, comprising a pumping chamber, a positive displacement element, an actuation member in operative connection with the positive displacement element and configured for displacing or deforming the positive displacement element in order to convey medical fluid into the pumping chamber or out of the pumping chamber, a drive device for displacing the actuation member, an inlet valve, an outlet valve, a displacement path sensor, and a control unit for controlling the drive device, the inlet valve, and the outlet valve, wherein the actuation member is in operative connection with the positive displacement element via a working chamber that is filled with gas and has a sealed volume, the displacement path sensor is configured to measure a length of a displacement path of the actuation member, to determine a measured displacement path, the working chamber has a cross-sectional area, the actuation member has an end face that partially defines the working chamber and has a second cross-sectional area, and the control unit configured such that a pump output or a conveyance rate is calculated from the product of the measured displacement path and either the cross-sectional area of the working chamber or the second cross-sectional area of the end face, and the control unit controls the drive device based on the calculated pump output or conveyance rate such that the pump output corresponds to a target pump output or such that the conveyance rate corresponds to a target conveyance rate.

2. The positive displacement pump according to claim 1, wherein the control unit comprises a pressure measuring device for measuring the pressure in the working chamber, the control unit being designed such that, in a pressure phase, the drive device is controlled depending on the pressure measured by the pressure measuring device such that pressure in the working chamber remains constant when the actuation member is displaced.

3. The positive displacement pump according to claim 2, wherein the control unit is designed such that the outlet valve is controlled such that an actual pump output corresponds to a target pump output or an actual conveyance rate corresponds to a target conveyance rate.

4. The positive displacement pump according to claim 3, further comprising a unit and a disposable, wherein the actuation device is on the unit and the pumping device is on the disposable, and the pumping device on the disposable is configured to couple to the actuation device on the unit such that an operative connection can be produced between the actuation member and the positive displacement element via the volume of gas enclosed in the working chamber.

5. The positive displacement pump according to claim 1, wherein the positive displacement element is a membrane that seals the pumping chamber.

6. The positive displacement pump according to claim 1, wherein the working chamber is a cylindrical body and the actuation member is a piston that is guided in the cylindrical body.

7. The positive displacement pump according to claim 1, wherein the drive device comprises an electric motor.

8. A medico-technical device comprising at least one positive displacement pump according to claim 1, for conveying a medical treatment fluid.

9. A method for controlling a positive displacement pump for pumping medical fluids, wherein the positive displacement pump comprises a pumping chamber, a positive displacement element, an actuation member in operative connection with the positive displacement element for displacing or deforming the positive displacement element, a drive device for displacing the actuation member, an inlet valve, an outlet valve, and a displacement path sensor, wherein the displacement path sensor is configured to measure a length of a displacement path of the actuation member, to determine a measured displacement path, the working chamber has a cross-sectional area, the actuation member has an end face that that partially defines the working chamber and has a second cross-sectional area, and the method comprises measuring a length of a displacement path of the actuation member to determine a measured displacement path, actuating the positive displacement element by the actuation member via a sealed volume of gas that is enclosed in a working space, calculating a pump output or a conveyance rate from the product of the measured displacement path and either the cross-sectional area of the working chamber or the second cross-sectional area of the end face, and driving the drive device based on the calculated pump output or conveyance rate such that the pump output corresponds to a target pump output or such that the conveyance rate corresponds to a target conveyance rate.

10. The method according to claim 9, wherein the actuation member is controlled depending on the pressure in the working space such that the pressure in the working space remains constant when the actuation member is displaced, and the outlet valve is actuated such that a pump output corresponds to a preset target pump output or a conveyance rate corresponds to a preset target conveyance rate.

11. A positive displacement pump for pumping medical fluids, comprising a pumping chamber, a positive displacement element, an actuation member in operative connection with the positive displacement element and configured for displacing or deforming the positive displacement element in order to convey medical fluid into the pumping chamber or out of the pumping chamber, a drive device for displacing the actuation member, an inlet valve, an outlet valve, and a control unit configured to control the drive device, the inlet valve, and the outlet valve, wherein the actuation member is in operative connection with the positive displacement element via a working chamber that is filled with gas and has a sealed volume, and the control unit comprises a pressure measuring device for measuring pressure in the working chamber, the control unit being designed such that, in a pressure phase, the outlet valve is controlled depending on the pressure measured by the pressure measuring device such that the pressure in the working chamber remains constant when the actuation member is displaced.

12. The positive displacement pump according to claim 11, wherein the control unit is designed such that the drive device is controlled such that a pump output corresponds to a preset target pump output or a conveyance rate corresponds to a preset target conveyance rate.

13. The positive displacement pump according to claim 12, wherein the control unit comprises a path sensor for measuring the displacement path of the actuation member, the control unit being designed such that, on the basis of the measured displacement path of the actuation member, an actual pump output or an actual conveyance rate is calculated and the drive device is controlled such that the actual pump output corresponds to the target pump output or the actual conveyance rate corresponds to the target conveyance rate.

14. A method for controlling a positive displacement pump for pumping medical fluids, wherein the positive displacement pump comprises a pumping chamber, a positive displacement element, an actuation member in operative connection with the positive displacement element for displacing or deforming the positive displacement element, a drive device for displacing the actuation member, an inlet valve, and an outlet valve, wherein the method comprises actuating the positive displacement element by the actuation member via a sealed volume of gas that is enclosed in a working space, actuating the outlet valve depending on the pressure in the working space such that the pressure in the working space remains constant when the actuation member is displaced, and displacing the actuation member such that a pump output corresponds to a preset target pump output or a conveyance rate corresponds to a preset target conveyance rate.

* * * * *